US010527961B2

(12) United States Patent
Tulchinski et al.

(10) Patent No.: US 10,527,961 B2
(45) Date of Patent: Jan. 7, 2020

(54) FLEXIBLE PRINTED MATERIAL

(71) Applicant: HP Indigo B.V., Amstelveen (NL)

(72) Inventors: Dani Tulchinski, Nes Ziona (IL); Asaf Salant, Nes Ziona (IL); Tony Azzam, Nazareth (IL); Einat Glick, Nes Ziona (IL); Inna Tzomik, Modiin (IL); Irit Levi, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/754,859

(22) PCT Filed: Oct. 23, 2015

(86) PCT No.: PCT/EP2015/074641

§ 371 (c)(1),
(2) Date: Feb. 23, 2018

(87) PCT Pub. No.: WO2017/067610

PCT Pub. Date: Apr. 27, 2017

(65) Prior Publication Data

US 2018/0246428 A1 Aug. 30, 2018

(51) Int. Cl.
*G03G 7/00* (2006.01)
*G03G 8/00* (2006.01)
(Continued)

(52) U.S. Cl.
CPC ..... *G03G 8/00* (2013.01); *B41M 1/305* (2013.01); *G03G 7/008* (2013.01); *G03G 7/0053* (2013.01);
(Continued)

(58) Field of Classification Search
CPC ..... B41M 1/28; B41M 1/305; B41M 7/009; G03G 7/0053; G03G 7/008; G03G 8/00; G03G 9/13; G03G 9/131
(Continued)

(56) References Cited

U.S. PATENT DOCUMENTS 8,440,749 B2 5/2013 Kagaya et al.
9,102,125 B2 8/2015 Battersby et al.
(Continued)

FOREIGN PATENT DOCUMENTS

EP 0136074 4/1985
EP 1285859 2/2003
(Continued)

OTHER PUBLICATIONS

International Search Report and Written Opinion for International Application No. PCT/EP2015/074641, dated Jul. 1, 2016, 11 pages.

*Primary Examiner* — Alexander M Weddle
(74) *Attorney, Agent, or Firm* — Dierker & Kavanaugh PC

(57) ABSTRACT

Described herein is a process for preparing a flexible printed material. The process may comprise providing a flexible print substrate comprising a primer on a surface of the print substrate, the primer comprising a primer resin; printing an ink composition comprising a thermoplastic resin onto the primer on the surface of the print substrate; and depositing a cross-linking composition comprising a cross-linker onto the printed ink composition disposed on the primer such that the thermoplastic resin of the ink composition is crosslinked and the primer resin of the primer is crosslinked.

18 Claims, 1 Drawing Sheet

(51) Int. Cl.

| | |
|---|---|
| ***G03G 9/13*** | (2006.01) |
| ***B41M 1/30*** | (2006.01) |
| *B41M 1/28* | (2006.01) |
| *B41M 7/00* | (2006.01) |

(52) U.S. Cl.
CPC ..... *G03G 9/131* (2013.01); *B41M 1/28* (2013.01); *B41M 7/009* (2013.01)

(58) Field of Classification Search
USPC ..... 428/195.1
See application file for complete search history.

(56) References Cited

U.S. PATENT DOCUMENTS

| | | | | |
|---|---|---|---|---|
| 10,273,372 | B2 * | 4/2019 | Or-Chen | C09D 11/00 |
| 2002/0054991 | A1 * | 5/2002 | Shibuya | C08J 7/047 428/319.3 |
| 2003/0049423 | A1 * | 3/2003 | Kammerer | B41M 1/26 428/204 |
| 2003/0056667 | A1 * | 3/2003 | Cruttenden | B65B 41/18 101/219 |
| 2004/0091807 | A1 * | 5/2004 | Qian | G03G 9/13 430/114 |
| 2004/0091808 | A1 * | 5/2004 | Qian | G03G 9/13 430/114 |
| 2006/0177636 | A1 | 8/2006 | Reich | |
| 2013/0101809 | A1 | 4/2013 | Kohlweyer et al. | |
| 2013/0224395 | A1 | 8/2013 | Regnier | |
| 2014/0030651 | A1 * | 1/2014 | Stolin Roditi | C09D 11/02 430/114 |
| 2014/0234771 | A1 * | 8/2014 | Bar-Haim | C09D 11/52 430/114 |
| 2014/0320576 | A1 * | 10/2014 | Bar-Haim | G03G 9/131 347/112 |
| 2014/0370252 | A1 | 12/2014 | Regnier | |
| 2017/0108792 | A1 * | 4/2017 | Azzam | G03G 9/12 |
| 2018/0004104 | A1 * | 1/2018 | Azzam | G03G 7/002 |
| 2018/0017883 | A1 * | 1/2018 | Azzam | G03G 9/131 |

FOREIGN PATENT DOCUMENTS

| | | |
|---|---|---|
| EP | 1571496 | 9/2005 |
| EP | 2730403 | 5/2014 |
| JP | 04-168168 | 6/1992 |
| JP | 10078682 | 3/1998 |
| JP | 2000247356 | 9/2000 |
| JP | 2003154749 | 5/2003 |
| JP | 2003175560 | 6/2003 |
| JP | 2003255601 | 9/2003 |
| JP | 2006168161 | 6/2006 |
| JP | 2010184391 | 8/2010 |
| JP | 2012208150 | 10/2012 |
| JP | 2013244697 | 12/2013 |
| JP | 2015529835 | 10/2015 |
| JP | 2018521913 | 8/2018 |
| JP | 2018530478 | 10/2018 |
| KR | 10-0497787 | 9/2005 |
| WO | WO-2007/130069 | 11/2007 |
| WO | WO-2014108491 | 7/2014 |
| WO | WO-2014160631 | 10/2014 |
| WO | WO-2014/187497 | 11/2014 |
| WO | WO-2015144212 | 10/2015 |
| WO | WO-2016128046 | 8/2016 |
| WO | WO-2016206724 | 12/2016 |
| WO | WO-2017059925 | 4/2017 |

* cited by examiner

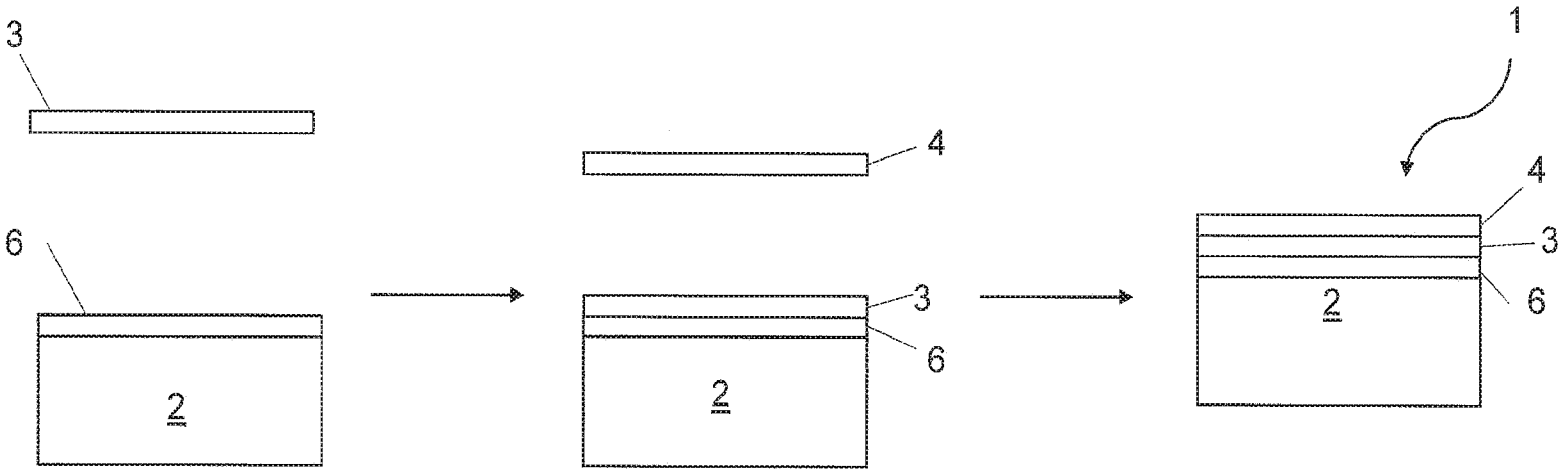
1
4
3
6
2
4
3
6
2
3
6
2

FLEXIBLE PRINTED MATERIAL

BACKGROUND

Flexible printed materials may be used to package and/or identify all manner of consumer goods, the printed images used, for example, to provide information, or corporate branding etc. to provide information to the user regarding the nature and origin of a product.

Some existing flexible printed materials have be found to be vulnerable to raised temperatures, mechanical wear and/or chemicals.

BRIEF DESCRIPTION OF THE FIGURE

The FIGURE shows a schematic process for producing a printed material.

DETAILED DESCRIPTION

Before the present disclosure is disclosed and described, it is to be understood that this disclosure is not restricted to the particular process features and materials disclosed herein because such process features and materials may vary somewhat. It is also to be understood that the terminology used herein is used for the purpose of describing particular examples.

It is noted that, as used in this specification and the appended claims, the singular forms "a," "an," and "the" include plural referents unless the context clearly dictates otherwise.

As used herein, "carrier fluid", "carrier liquid," "carrier," or "carrier vehicle" refers to the fluid in which pigment particles, colorant, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "electrostatic ink composition" or "liquid electrophotographic composition" generally refers to an ink composition that is generally suitable for use in an electrostatic printing process, sometimes termed an electrophotographic printing process. It may comprise pigment particles, which may comprise a thermoplastic resin.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not just pigment colorants, but other pigments such as organometallics, ferrites, ceramics, etc.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise. In some examples, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid composition is employed in the electrophotographic process rather than a powder toner. An electrostatic printing process may involve subjecting the electrostatic composition to an electric field, e.g. an electric field having a field gradient of 50-400V/μm, or more, in some examples 600-900V/μm, or more.

As used herein, "substituted" may indicate that a hydrogen atom of a compound or moiety us replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl" may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

As used herein, "alkyl", or similar expressions such as "alk" in alkoxy, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more, and may be selected from, phenyl and naphthyl.

As used herein, the term "about" is used to provide flexibility to a numerical range endpoint by providing that a given value may be a little above or a little below the endpoint to allow for variation in test methods or apparatus. The degree of flexibility of this term can be dictated by the particular variable as would be understood in the art.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

In an aspect there is provided a process for preparing a printed flexible material. The process may comprise:

- providing a flexible print substrate comprising a primer on a surface of the print substrate, the primer comprising a primer resin;
- printing an ink composition comprising a thermoplastic resin onto the primer on the surface of the print substrate;
- depositing a cross-linking composition comprising a cross-linker onto the printed ink composition disposed on the primer such that the thermoplastic resin of the ink composition is crosslinked and the primer resin of the primer is crosslinked.

In some example, there is provided a flexible printed material obtained by the process described herein.

In another aspect there is provided a flexible printed material. The flexible printed material may comprise:

- a flexible print substrate;
- a primer layer comprising a primer resin disposed on a surface of the print substrate;
- a printed ink layer comprising a thermoplastic resin disposed on the primer layer; and
- a cross-linker applied to the printed ink layer such that the thermoplastic resin is crosslinked and the primer resin is crosslinked.

In another aspect there is provided a flexible package comprising a flexible printed material. The flexible package may comprise a flexible printed material as described herein or as obtained by the process described herein. The flexible package may comprise a flexible printed material comprising:

- a flexible print substrate;
- a primer layer comprising a primer resin disposed on surface of the print substrate;
- a printed ink layer comprising a thermoplastic resin disposed on the primer layer; and
- a cross-linker applied to the printed ink layer such that the thermoplastic resin is crosslinked and the primer resin is crosslinked.

The present inventors have found that examples of the methods and products as described herein avoid or at least mitigate at least one of the difficulties described above. They have found that examples of the method and products are more successful than previous methods in that the materials produced have been found to have improved thermal resistance, mechanical resistance and/or chemical resistance.

Flexible Printed Material

In some examples, a flexible printed material is described, in some examples a printed packaging material or a flexible printed packaging material. The flexible printed material may be produced by any of the methods described herein. Each component of the flexible printed material will be discussed in the sections which follow.

Flexible Print Substrate

The flexible print substrate, to which an ink composition may be printed (and thus is also referred to herein as the print substrate) may be any flexible material suitable for use in a printed material, e.g. a flexible printed packaging material.

The flexible print substrate of the flexible printed material may also be referred to as a functional substrate or simply a base layer. The flexible print substrate of the printed material may be the innermost layer of a printed packaging material (e.g. a flexible printed packaging material) in use, and may thus be in contact with packaged goods. In some examples the flexible print substrate is referred to as a functional substrate and is functional in the sense that it provides a barrier function to protect packaged goods. The flexible print substrate or functional substrate may serve as a barrier to any external influence that could damage or otherwise reduce the quality of packaged goods, in particular food, by preventing ingress of, for example, moisture, oxygen, other oxidants and pathogens such as viruses and bacteria.

The flexible print substrate may be any suitable substrate. The flexible print substrate may be any suitable flexible print substrate capable of having an image printed thereon. The flexible substrate may include a material selected from an organic or inorganic material. The flexible material may include a natural polymeric material, e.g. cellulose. The flexible material may include a synthetic polymeric material, e.g. a polymer formed from alkylene monomers, including, for example, polyethylene and polypropylene, and co-polymers such as styrene-polybutadiene. The polypropylene may, in some examples, be biaxially orientated polypropylene. The flexible material may include a metal, which may be in sheet form. The metal may be selected from or made from, for instance, aluminium (Al), silver (Ag), tin (Sn), copper (Cu), mixtures thereof. In an example, the flexible substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the LEP ink is printed onto the print substrate. In some examples, the print substrate is a transparent print substrate, for example the print substrate may be formed from a transparent material such as a transparent polymeric material, e.g. a polymer formed from alkylene monomers, including, for example, polyethylene and polypropylene, and co-polymers such as styrene-polybutadiene.

In some examples, the flexible print substrate comprises a film or sheet, e.g. a thin film or thin sheet, of paper, metallic foil, and a plastic material. In some examples, the print substrate comprises a metallic foil or a metallized substrate. In some examples, the print substrate comprises a metallized paper or a metallized plastic film. In some examples, the print substrate comprises an aluminium foil. In some examples, the print substrate comprises a polymeric material. In some examples the print substrate comprises a film, e.g. a thin film, of a plastic material, for example, polyethylene (PE), linear low density polyethylene (LLDPE), low density polyethylene (LDPE), medium density polyethylene (MDPE), high density polyethylene (HDPE) polypropylene (PP), cast (cPP) or axially oriented polypropylene (BOPP), oriented polyamide (OPA), or polyethylene terephthalate (PET).

In some examples, the flexible print substrate comprises a plurality of layers of film of material laminated together to form a pre-laminated flexible print substrate. In some examples, the flexible print substrate comprises a plurality of layers of material selected from polymeric materials (e.g. polymeric materials selected from PE, LLDPE, MDPE, PP, BOPP, PET and OPA), metallic materials (e.g. metallic foils such as aluminium foil, or metallized films such as met-PET, met-BOPP or any other metalized substrate), paper and combinations thereof. In some examples, the flexible print substrate comprises a plurality of layers of film of a plastic material, such as a combination of films selected from PE, LLDPE, MDPE, PP, BOPP, PET and OPA, laminated together to form the pre-laminated flexible print substrate. In some examples, the pre-laminated flexible print substrate comprises an aluminium layer. In some examples, the pre-laminated flexible print substrate comprises a Paper/Alu/PE, PET/Al/PE, BOPP/met-BOPP or PET/PE laminate.

In some examples, the flexible print substrate comprises a metallized paper in the form of a paper substrate coated on one surface with a layer of metal, for example aluminium.

In some examples, the flexible print substrate comprises a metallized plastic film in the form of a polymer substrate coated on one surface with a layer of metal, for example aluminium. In some examples, the print substrate comprises a metallized plastic film in the form of a metallized BOPP film or a metallized PET film.

In some examples, the print substrate comprises a thin film of material, wherein the film is less than 600 μm in thickness, for example less than 250 μm in thickness, for example less than 200 μm in thickness, for example less than 150 μm in thickness, for example less than 100 μm in thickness for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. In some examples, the film of material is about 12 μm in thickness.

In some examples, the print substrate comprises a thin film of material, wherein the film is greater than 12 μm in thickness, for example greater than 15 μm in thickness, greater than 20 μm in thickness, greater than 30 μm in thickness, greater than 40 μm in thickness, greater than 50 μm in thickness, greater than 60 μm in thickness, greater than 70 μm in thickness, greater than 80 μm in thickness, greater than 90 μm in thickness. In some examples, the film of material greater than about 100 μm in thickness, in some examples about 100 μm in thickness.

In some examples, the flexible print substrate has a first surface on which an ink composition may be printed. In some examples, the flexible print substrate has a second surface which is a surface other than the surface on which the ink composition in use is printed, for example the second surface may be a surface opposing the first surface of the flexible print substrate.

In some examples, the flexible printed material comprises a sealant layer disposed on a surface of the flexible print substrate other than a surface to which the ink composition is printed, e.g. the sealant layer may be disposed on a second surface of the print substrate. In some examples, the print substrate has a first surface on which the ink composition is printed and a second surface on which a sealant layer may be disposed.

In some examples, the sealant layer is disposed on the innermost surface of a flexible printed material, e.g. the flexible printed packaging material, and serves to provide means for sealing the flexible printed material to itself or another material, with the goods to be packaged inside, for example to form a flexible printed packaging material. In some examples the sealant layer comprises a film of low-melting, i.e. heat sealable, thermoplastic material. Suitable thermoplastic materials include those described herein in connection with the polymer resin (the polymer resin described herein being an example of a thermoplastic resin of an ink composition when the ink composition is an electrostatic ink composition) and include polymers of ethylene, or DuPont's SURLYN® ionomers. In some examples, the sealant layer comprises an extrudable material.

In some examples, the sealant layer comprises a thin film of a polymer, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. In some examples, the film of polymer is about 12 μm in thickness.

In some examples, the sealant layer comprises a thin film of a polymer, wherein the film is greater than 12 μm in thickness, for example greater than 15 μm in thickness, greater than 20 μm in thickness, greater than 30 μm in thickness, greater than 40 μm in thickness, greater than 50 μm in thickness, greater than 60 μm in thickness, greater than 70 μm in thickness, greater than 80 μm in thickness, greater than 90 μm in thickness. In some examples, the film of polymer is about 100 μm in thickness.

Primer

The flexible print substrate may have a primer on a surface onto which the ink composition is printed. In some examples, the print substrate has a first surface on which a primer is disposed, the ink composition may then be printed on the primer disposed on the surface of the print substrate.

The primer comprises a primer resin. In some examples, the primer resin may be selected from the group comprising or consisting of hydroxyl containing resins, carboxylic group containing resins, and amine based polymer formulations. In some examples a hydroxyl containing resin may be selected from polyvinyl alcohol resins, e.g. polyvinyl alcohol based as polyvinyl butyral formulation (Butvar, Eastman), Vinnol® (Wacker polymers), cellulose derivative additives (Eastman), polyester (Dynapol, Evonic) and polyurethane based formulation with hydroxyl groups. In some examples, the carboxylic group containing resins may be selected from: olefin co-acrylic or methacrylic acid based copolymers, polyacrylic acid based polymers, polylactic acid based polymers. In some examples, the amine based polymer formulations may be selected from polyamines, polyethylene imines. The primer resin may be selected from the group comprising, or consisting of, a polyvinyl alcohol resin, cellulose based resins, a polyester, a polyamine, a polyethylene imine resin, polyamide resin, polyurethane, copolymers of an alkylene monomer and an acrylic or methacrylic acid monomer, and polyacrylic polymers In some examples, the primer resin comprises a carboxylic functional group, an amine functional group or a polyol functional group. In some examples, the primer resin comprises an amine functional group or a carboxylic functional group.

In some examples, the primer resin comprises an amine functional group. In some examples, the primer resin comprises or consists of a polyethylene imine resin. An example of a material suitable as a primer is DP050 (available from Michelman, Inc.).

In some examples, the primer layer on the print substrate of the printed material comprises a crosslinked primer resin.

In some examples, the primer on the surface of the flexible print substrate surface onto which the ink composition is printed is provided in an amount such that the coat weight of the primer resin on the print substrate is at least 0.01 $g/m^2$, in some examples at least 0.05 $g/m^2$, in some examples at least 0.1 $g/m^2$, in some examples at least 0.15 $g/m^2$, in some examples about 0.18 $g/m^2$. In some examples the primer is provided in an amount such that the coat weight of the primer resin on the print substrate is up to about 0.2 $g/m^2$, in some examples up to about 0.5 $g/m^2$, in some examples up to about 1 $g/m^2$, in some examples up to about 1.5 $g/m^2$.

Ink Composition

The ink composition which may be printed onto the flexible print substrate, for example a first surface of the flexible print substrate on which a primer is disposed, may comprise a thermoplastic resin.

In some examples, the ink composition may be a liquid ink composition such as a solvent based or solvent free ink composition used for offset, flexographic or rotogravure technologies, or a powder ink composition such as powder form resins used for toner technology, e.g. dry electrostatic printing.

In some examples, the thermoplastic resin of the ink composition comprises a carboxylic functional group, an amine functional group or a polyol functional group. In some examples, the thermoplastic resin of the ink composition comprises a carboxylic functional group.

In some examples, the thermoplastic resin comprises a polymer having acidic side groups. In some examples, the acidic side groups may be in free acid form or may be in the form of an anion and associated with a counterion, generally metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

In some examples, the thermoplastic resin of the ink composition comprises polyolefin copolymers, polyethylene co-acrylic copolymers, polyethylene co-methacrylic copolymers, polyethylene co-vinyl acetate copolymers, ionomers, or combinations thereof. In some examples the thermoplastic resin of the ink composition comprises or consists of alkylene acrylic or methacrylic acid resins, polyurethane resins, polyethylene imine resins, polyamide resin, polyvinyl alcohol and combinations thereof.

The ink composition may be an electrostatic ink composition, for example a liquid electrophotographic ink composition. In some examples, the ink composition is a liquid electrophotographic (LEP) ink composition comprising a thermoplastic resin. In some examples, the thermoplastic resin comprises or consists of a polymer having acidic side groups. In some examples the electrostatic ink composition comprises a thermoplastic resin comprising a copolymer of an alkylene monomer and a monomer selected from acrylic acid and methacrylic acid.

Electrostatic Ink Composition

Electrostatic printing, e.g. liquid electrostatic printing, is one method by which images or information can be printed onto substrates such as paper or plastic. The printing processes generally involve creating an image on a photoconductive surface, applying an ink or toner having charged particles to the photoconductive surface, such that they selectively bind to the image, and then transferring the charged particles in the form of the image to a print substrate.

The ink composition printed on the print substrate described herein may be an electrostatic ink composition, for example a liquid electrophotographic printing composition (also referred to herein as a LEP composition), printed on the print substrate using an electrophotographic printing process, e.g. a LEP printing process. In some examples, the electrostatic ink composition may comprise a colorant or pigment and a polymer resin. An LEP composition may comprise a colorant or pigment, a polymer resin and a carrier fluid or liquid. The LEP composition may further comprise an additive such as a charge director, charge adjuvant, surfactant, viscosity modifier, emulsifier and the like. In some examples, the LEP composition may not contain any pigment, or comprise substantially zero pigment and thus be a pigment-free composition, useful in providing a particular transparent gloss or sheen to a printed substrate.

In some examples, after printing, a LEP ink composition, which may be printed on the print substrate, may comprise a reduced amount of carrier liquid compared with the LEP printing composition before printing. In some examples, a LEP ink composition, which may be printed on the print substrate, may be substantially free from carrier liquid. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, an electrostatic ink composition that may be printed on the print substrate is free from carrier liquid.

Each of these components of an electrostatic ink composition, which may be the ink composition printed on the print substrate, will be described separately in the sub-sections which follow.

Colorant

An electrostatic ink composition may comprise a colorant. The colorant may be a dye or pigment. The colorant can be any colorant compatible with the liquid carrier and useful for electrophotographic printing. For example, the colorant may be present as pigment particles, or may comprise a resin (in addition to the polymers described herein) and a pigment. The resins and pigments can be any of those standardly used. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including C74-1357 Yellow, C75-1331 Yellow, C75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200. Where the pigment is a white pigment particle, the pigment particle may be selected from the group consisting of $TiO_2$, calcium carbonate, zinc oxide, and mixtures thereof. In some examples the white pigment particle may comprise an alumina-$TiO_2$ pigment.

In some examples, the colorant or pigment particles may have a median particle size or $d_{50}$ of less than 20 μm, for example less than 15 μm, for example less than 10 μm, for example less than 5 μm, for example less than 4 μm, for example less than 3 μm, for example less than 2 μm, for example less than 1 μm, for example less than 0.9 μm, for example less than 08 μm, for example less than 0.7 μm, for example less than 0.6 μm, for example less than 0.5 μm. Unless otherwise stated, the particle size of the colorant or pigment particle and the resin coated pigment particle is determined using laser diffraction on a Malvern Mastersizer 2000 according to the standard procedure as described in the operating manual.

The colorant or pigment particle may be present in an electrostatic ink composition in an amount of from 10 wt % to 80 wt % of the total amount of resin and pigment, in some examples 15 wt % to 80 wt %, in some examples 15 wt % to 60 wt %, in some examples 15 wt % to 50 wt %, in some examples 15 wt % to 40 wt %, in some examples 15 wt % to 30 wt % of the total amount of resin and colorant. In some examples, the colorant or pigment particle may be present in an electrostatic ink composition in an amount of at least 50 wt % of the total amount of resin and colorant or pigment, for example at least 55 wt % of the total amount of resin and colorant or pigment.

Polymer Resin

In some examples, the ink composition is an electrostatic ink composition comprising a polymer resin as the thermoplastic resin. In some examples, the electrostatic ink composition comprises a polymer resin comprising a polymer having acidic side groups. In some examples, the electrostatic ink composition comprises a polymer resin comprising a copolymer of an alkylene monomer and a monomer selected from acrylic acid and methacrylic acid.

The polymer resin or thermoplastic resin may be referred to as a thermoplastic polymer. In some examples, the polymer resin may comprise ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers or combinations thereof.

The polymer resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures, for example using the procedure described in ASTM D1386.

The polymer resin may comprise a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures, for example as described in ASTM D1238.

The acidic side groups may be in free acid form or may be in the form of an anion and associated with a counterion, generally metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The polymer resin may comprise two different polymers having acidic side groups. The two polymers having acidic side groups may have different acidities, which may fall within the ranges mentioned above. The polymer resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The polymer resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The polymer resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The polymer resin may comprise a first polymer having a melt viscosity of 15000 poise or more, in some examples 20000 poise or more, in some examples 50000 poise or more, in some examples 70000 poise or more; and in some examples, the polymer resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The polymer resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

If the polymer resin comprises a single type of polymer, the polymer (excluding any other components of the electrophotographic ink composition) may have a melt viscosity of 6000 poise or more, in some examples a melt viscosity of 8000 poise or more, in some examples a melt viscosity of 10000 poise or more, in some examples a melt viscosity of 12000 poise or more. If the polymer resin comprises a plurality of polymers all the polymers of the polymer resin may together form a mixture (excluding any other components of the electrophotographic ink composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate.

The polymer resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The polymer resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The polymer resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, for example, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the liquid electrophotographic ink composition and/or the ink printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic composition and/or the ink printed on the print substrate. The polymer having ester side groups may constitute from 5% to 50% by weight of the total amount of the resin polymers, e.g. thermoplastic resin polymers, in the liquid electrophotographic composition and/or the ink printed on the print substrate, in some examples 10% to 40% by weight of the total amount of the resin polymers, e.g. thermoplastic resin polymers, in the liquid electrophotographic composition and/or the ink composition printed on the print substrate, in some examples 5% to 30% by weight of the total amount of the resin polymers, e.g. thermoplastic resin polymers, in the liquid electrophotographic composition and/or the ink composition printed on the print substrate, in some examples 5% to 15% by weight of the total amount of the resin polymers, e.g. thermoplastic resin polymers, in the liquid electrophotographic composition and/or the ink composition printed on the print substrate in some examples 15% to 30% by weight of the total amount of the resin polymers, e.g. thermoplastic resin polymers, in the liquid electrophotographic composition and/or the ink composition printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the thermoplastic resin can in some examples be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, Bynell 2020 and Bynell 2022, (sold by E. I. du PONT)), the AC family of toners (e.g. AC-5120, AC-5180, AC-540, AC-580 (sold by Honeywell)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

The polymer resin can constitute about 5 to 90%, in some examples about 50 to 80%, by weight of the solids of the liquid electrophotographic composition and/or the ink composition printed on the print substrate. The resin can constitute about 60 to 95%, in some examples about 70 to 95%, by weight of the solids of the liquid electrophotographic composition and/or the ink composition printed on the print substrate.

Carrier Liquid

In some examples, an electrostatic ink composition described herein comprises polymer resin coated pigment particles, or polymer resin particles, which are formed in and/or dispersed in a carrier fluid or carrier liquid. Before application to the print substrate, e.g. the print substrate, in a printing process, e.g. an electrostatic printing process, the ink composition may be an electrostatic ink composition, which may be in dry form, for example in the form of flowable pigment particles coated with the thermoplastic resin. In some examples, before application to the print substrate in an electrostatic printing process, an electrostatic ink composition may be in liquid form; and may comprise a carrier liquid in which is suspended pigment particles coated with the thermoplastic resin.

Generally, the carrier liquid acts as a reaction solvent in preparing the coated pigment particles, and can also act as a dispersing medium for the other components in the resulting electrostatic ink composition. In some examples, the carrier liquid is a liquid which does not dissolve the polymer resin at room temperature. In some examples, the carrier liquid is a liquid which dissolves the polymer resin at elevated temperatures. For example, the polymer resin may be soluble in the carrier liquid when heated to a temperature of at least 80° C., for example 90° C., for example 100° C., for example 110° C., for example 120° C. For example, the carrier liquid can comprise or be a hydrocarbon, silicone oil, vegetable oil, etc. The carrier liquid can include an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include hydrocarbons. The hydrocarbon can include an aliphatic hydrocarbon, an isomerized aliphatic hydrocarbon, branched chain aliphatic hydrocarbons, aromatic hydrocarbons, and combinations thereof. Examples of the carrier liquids include aliphatic hydrocarbons, isoparaffinic compounds, paraffinic compounds, dearomatized hydrocarbon compounds, and the like. In particular, the carrier liquids can include Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF4™, AF-5™, AF6™ and AF7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of an electrostatic ink composition, in some examples 50% to 99.5% by weight of an electrostatic ink composition. Before printing, the carrier liquid may constitute about 40 to 90% by weight of an electrostatic ink composition. Before printing, the carrier liquid may constitute about 60% to 80% by weight of an electrostatic ink composition. Before printing, the carrier liquid may constitute about 90% to 99.5% by weight of an electrostatic ink composition, in some examples 95% to 99% by weight of an electrostatic ink composition.

An electrostatic ink composition, when printed on a print substrate, e.g. the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink printed on a print substrate, e.g. the print substrate, is free from carrier liquid.

Charge Director and Charge Adjuvant

A liquid electrophotographic composition and/or the ink composition printed on the print substrate can comprise a charge director. A charge director can be added to an electrostatic composition to impart a charge of a desired polarity and/or maintain sufficient electrostatic charge on the particles of an electrostatic ink composition. The charge director may comprise ionic compounds, including, for example, metal salts of fatty acids, metal salts of sulfosuccinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, for example, barium, sodium, calcium, and aluminium salts of sulfonic acid. The sulfonic acids may include, for example, alkyl sulfonic acids, aryl sulfonic acids, and sulfonic acids of alkyl succinates (e.g. see WO 2007/130069). The charge director can impart a negative charge or a positive charge on the resin-containing particles of an electrostatic ink composition.

The charge director can comprise a sulfosuccinate moiety of the general formula: $[R_a—O—C(O)CH_2CH(SO_3^-)C(O)—O—R_b]$, where each of $R_a$ and $R_b$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_a—O—C(O)CH_2CH(SO_3^-)C(O)—O—R_b]$, where each of $R_a$ and $R_b$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above.

The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from Mg, Ca, Ba, $NH_4$, tert-butyl ammonium, $Li^+$, and $Al^{+3}$, or from any sub-group thereof. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further comprise basic barium petronate (BBP).

In the formula $[R_a—O—C(O)CH_2CH(SO_3^-)C(O)—O—R_b]$, in some examples, each of $R_a$ and $R_b$ is an aliphatic alkyl group. In some examples, each of $R_a$ and $R_b$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3^-)C(O)—O—R_b]$ and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In an electrostatic ink composition, the charge director can constitute about 0.001% to 20%, in some examples 0.01 to 20% by weight, in some examples 0.01 to 10% by weight, in some examples 0.01 to 1% by weight of the solids of an electrostatic ink composition and/or ink composition printed on the print substrate. The charge director can constitute about 0.001 to 0.15% by weight of the solids of a liquid electrophotographic ink composition and/or ink composition printed on the print substrate, in some examples 0.001 to 0.15%, in some examples 0.001 to 0.02% by weight of the solids of a liquid electrophotographic ink composition and/or ink composition printed on the print substrate. In some examples, a charge director imparts a negative charge on an electrostatic ink composition. The particle conductivity may range from 50 to 500 pmho/cm, in some examples from 200-350 pmho/cm.

A liquid electrophotographic ink composition and/or ink composition printed on the print substrate can include a charge adjuvant. A charge adjuvant may be present with a charge director, and may be different to the charge director, and act to increase and/or stabilise the charge on particles, e.g. resin-containing particles, of an electrostatic composition. The charge adjuvant can include barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of a liquid electrophotographic ink composition and/or ink composition printed on the print substrate. The charge adjuvant can constitute about 0.5 to 4% by weight of the solids of a liquid electrophotographic ink composition and/or ink composition printed on the print substrate. The charge adjuvant can constitute about 1 to 3% by weight of the solids of a liquid electrophotographic ink composition and/or ink composition printed on the print substrate.

Other Additives

In some examples, an electrostatic ink composition may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

Cross-Linking Composition

The cross-linking composition may comprise a cross-linker, for example for cross-linking thermoplastic resin of the ink composition and for cross-linking the primer resin of the primer. Depositing a cross-linking composition comprising a cross-linker onto the printed ink composition, e.g. printed ink layer, disposed on the primer on a surface of the print substrate may crosslink the thermoplastic resin of the ink composition and crosslink the primer resin of the primer. Crosslinking the thermoplastic resin of the ink composition may increase cohesion in the printed ink composition disposed on the print substrate. Crosslinking the thermoplastic resin of the ink composition may increase the melting temperature of the ink composition. Crosslinking the primer resin of the primer may increase cohesion within the primer and/or improve water resistance of the primer. Crosslinking the primer resin may also limit mobility of the ink composition disposed on the primer layer. Crosslinking between the primer resin and the thermoplastic resin may improve binding between the primer and the ink composition, reduce the mobility of the ink composition and/or the primer, and/or increase the melting temperature of the ink composition. Crosslinking of the primer resin of the primer, crosslinking of the thermoplastic resin of the ink composition and/or crosslinking of the primer resin of the primer to the thermoplastic resin of the ink composition may improve the mechanical durability and chemical resistance of the printed flexible material.

The cross-linker may be any cross-linker suitable to crosslink the thermoplastic resin of the ink composition and to crosslink the primer resin of the primer.

In some examples, the cross-linker may crosslink the thermoplastic resin within the ink composition, crosslink the primer resin within the primer and crosslink the thermoplastic resin of the ink composition with the primer resin of the primer.

In some examples, the cross-linking composition comprises a cross-linker which is reactive towards a carboxylic functional group, an amine functional group, a polyol functional group, or a combination thereof.

In some examples, the cross-linking composition comprises a cross-linker which is reactive towards a carboxylic functional group and/or an amine functional group.

In some examples, the cross-linker may crosslink the thermoplastic resin within the ink composition, crosslink the thermoplastic resin of the ink composition with the primer resin of the primer and crosslink the primer resin within the primer.

For example, when the thermoplastic resin and/or the primer resin comprise a carboxylic functional group the cross-linker may comprise an epoxide, an aziridine, an organic metallic complex or ion, an organosilane, an epoxy organosilane, a carbodiimide, an isocyanate or an acetyl acetonate.

For example, when the thermoplastic resin and/or the primer resin comprise an amine functional group, the cross-linker may comprise an epoxide, an aziridine, an isocyanate, a maleic anhydride, an isocyanate alkyl organosilane, an epoxy organosilane, a carbodiimide, an aldehyde, a ketone, an acetyl acetonate, an isothiocyanate, an acyl azide, an NHS ester, a sulfonyl chlorides glyoxal, a carbonate, an aryl halide or an imidoester.

In some examples, when the thermoplastic resin comprises a polymer having acid side groups and the primer resin comprises an amine functional group (e.g. polyethylene imine), the cross-linker may be selected from an epoxy-based cross-linker, an aziridine-based cross-linker, an isocyanate-based cross-linker or a carbodiimde-based cross-linker. In some examples, when the thermoplastic resin comprises a polymer having acid side groups and the primer resin comprises an amine functional group (e.g. polyethylene imine), the cross-linker may be an epoxy-based cross-linker.

In some examples, the cross-linking composition comprises a cross-linker selected from an epoxide, an aziridine, an isocyanate, a maleic anhydride, an organic metallic complex or ion, an organosilane, an epoxy organosilane, a carbodiimide, an aldehyde, a ketone, an acetyl acetonate or combinations thereof. For example, the cross-linking composition may comprise an epoxide, an aziridine, an isocyanate, a maleic anhydride, an organic metallic complex or ion, an organosilane, an epoxy organosilane, a carbodiimide, an aldehyde, a ketone, an acetyl acetonate or combinations thereof.

In some examples, the cross-linking composition comprises a cross-linker selected from an epoxide, an aziridine, an isocyanate and a carbodiimide. For example, the cross-linking composition may comprise an epoxide, an aziridine, an isocyanate, or a carbodiimide.

In some examples, the cross-linking composition comprises a cross-linker selected from an epoxide, an aziridine, and a carbodiimide. For example, the cross-linking composition may comprise an epoxide, an aziridine, or a carbodiimide.

In some examples the cross-linking composition comprises an epoxide as the cross-linker.

In some examples, the cross-linking composition comprises a cross-linker in an amount greater than about 0.01 wt. % by total weight of the cross-linking composition, in some examples greater than about 0.1 wt. %, in some examples greater than about 0.5 wt. %, in some examples greater than about 1 wt. %, in some examples greater than about 1.5 wt. %, in some examples greater than about 2 wt. %, in some examples greater than about 2.5 wt. %, in some examples greater than about 3 wt. %, in some examples about 4 wt. % or greater, in some examples about 5 wt. % or greater, in some examples about 5 wt. %.

In some examples, the cross-linking composition comprises a cross-linker in an amount up to about 20 wt. % by total weight of the cross-linking composition, in some examples up to about 15 wt. %, in some examples up to about 10 wt. %. The remaining wt. % of the cross-linking composition may be a carrier solvent as described below.

In some examples, the cross-linking composition comprises a cross-linker in an amount within the range of about 0.5 wt. % to about 10 wt. % by total weight of the cross-linking composition.

In some examples the cross-linking composition comprises a carrier solvent in which the cross-linker may be dissolved or dispersed. In some examples, the carrier solvent is selected from water, ethyl acetate, ethanol, methyl ethyl ketone, acetone, isopropanol and combinations thereof.

In some examples, the cross-linking composition comprises a carrier solvent present in an amount of about 80 wt. % or more by total weight of the cross-linking composition, in some examples about 85 wt. % or more, in some examples about 90 wt. % or more, in some examples about 95 wt. %.

In some examples, the cross-linking composition comprises a carrier solvent present in an amount up to about 99.99 wt. %, in some examples up to about 99.95 wt. %, in some examples up to about 99.5 wt. %, in some examples up to about 99 wt. %, in some examples up to about 98.5 wt. %, in some examples up to about 98 wt. %, in some examples up to about 97 wt. %, in some examples up to about 96 wt. %, in some examples up to about 95 wt. %, in some examples up to about 90 wt. %, in some examples up to about 85 wt. %, in some examples up to about 80 wt. %.

In some examples, the cross-linking composition comprises a carrier solvent present in an amount in the range of about 80 wt. % to about 99.99 Wt. %.

In some examples, the cross-linking composition comprises:

a cross-linker in an amount within the range of about 0.5 wt. % to about 10 wt. % by total weight of the cross-linking composition; and a carrier solvent in an amount within the range of about 90 wt. % to about 99.5 wt. %.

In some examples, the cross-linking composition may comprise a photo-initiator.

The cross-linker may comprise a group selected from epoxy, azriridine, isocyanate, maleic anhydride, anhydride, organosilane, epoxy oganosilane, carbodiimide, aldehyde, ketone, acetyl acetonate, organic metallic complexes or ions, or a combination thereof.

In some examples, cross-linker may be an epoxy-based cross-linker, azriridine-based cross-linker, isocyanate-based cross-linker, maleic anhydride-based cross-linker, anhydride-based cross-linker, organosilane-based cross-linker, epoxyoganosilane-based cross-linker, carbodiimide-based cross-linker, aldehyde-based cross-linker, ketone-based cross-linker, acetyl acetonate-based cross-linker as described below.

In some examples, the cross-linker has a molecular weight of more than 5000 Daltons. In some examples, the cross-linker has a 20 molecular weight of 5000 Daltons or less, in some examples 4000 Daltons or less, in some examples, 3000 Daltons or less, in some examples 1500 Daltons or less, in some examples a molecular weight of 1000 Daltons or less, in some examples a molecular weight of 700 Daltons or less, in some examples a molecular weight of 600 Daltons or less. In some examples, the cross-linker has a molecular weight of 25 from 100 to 1500 Daltons, in some examples, in some examples a molecular weight of from 100 to 600 Daltons.

In some examples, the cross-linker comprises a group selected from epoxy, aziridine, isocyanate or carbodiimide.

In some examples, the cross-linker comprises a polyepoxide, a polyaziridine, a polyisocyanate or a polycarbodiimide.

In some examples, the cross-linker is an epoxy-based cross-linker, for example a polyepoxide.

The term 'polyepoxide' is used herein to refer to a molecule comprising at least two epoxy groups, e.g. of the formula —CH(O)$R^1$H, wherein $R^1$ is selected from H and alkyl, in some examples wherein $R^1$ is H.

In some examples, the epoxy-based cross-linker is of the formula (I).

$$(X)—(Y—[Z—F]_m)_n$$

wherein, in each $(Y—[Z—F]_m)$, Y, Z and F are each independently selected, such that F is an epoxy group, e.g. of the formula —CH(O)$R^1$H, wherein $R^1$ is selected from H and alkyl;

Z is alkylene,

Y is selected from (i) a single bond, —O—, —C(═O)—O—, —O—C(═O)— wherein m is 1 or (ii) Y is $NH_{2-m}$ wherein m is 1 or 2, n is at least 1, in some example at least 2, in some examples 2-4, and X is an organic group.

In some examples, the cross-linker of formula (I) has at least two F groups.

In some examples, F is an epoxide of the formula —CH(O)C$R^1$H in which $R^1$ is H X may comprise or be an organic group selected from optionally substituted alkylene, optionally substituted alkyl, optionally substituted aryl, optionally substituted arylalkyl, optionally substituted alkylaryl, isocyanurate, and a polysiloxane. X may comprise a polymeric component; in some examples the polymeric components may be selected from a polysilane, polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples X comprises a polymeric backbone, comprising a plurality of repeating units, each of which is covalently bonded to $(Y—[Z—F]_m)$, with Y, Z, F and m as described herein. X may be selected from a group selected from a branched or straight-chain $C_{1-5}$ alkyl (e.g. methyl), phenyl, methylene bisphenyl, trisphenylmethane, cyclohexane, isocyanurate.

In some examples, Y is selected from a single bond, —O—, —C(═O)—O—, —O—C(═O)—, m is 1, and X is an organic group selected from alkylene (e.g. $C_{1-6}$alkylene), optionally substituted alkylene (e.g. $C_{1-6}$ alkylene), aryl (e.g. $C_{5-12}$ aryl), optionally substituted aryl (e.g. $C_{5-12}$ aryl), arylalkyl (e.g. $C_{6-20}$ arylalkyl), optionally substituted arylalkyl (e.g. $C_{6-20}$ arylalkyl), alkylaryl (e.g. $C_{6-20}$ alkylaryl) and optionally substituted alkylaryl (e.g. $C_{6-20}$ alkylaryl). In some examples, Y is selected from a single bond, —O—, —C(═O)—O—, —O—C(═O)—, m is 1, and X is an organic group selected from alkylene, aryl, arylalkyl, and alkylaryl. In some examples, Y is selected from a single bond, —O—, —C(═O)—O—, —O—C(═O)—, m is 1, and X is an organic group selected from $C_{1-6}$ alkylene, $C_{5-12}$ aryl, $C_{6-20}$ arylalkyl, and $C_{6-20}$ alkylaryl. In some examples, Y is selected from a single bond, —O—, —C(═O)—O—, —O—C(═O)—, m is 1, and X is an organic group selected from $C_{1-6}$ alkylene (e.g. methylene), phenyl, methylene bisphenyl, trisphenylmethane, cyclohexane.

In some examples, X is selected from (i) an alkane, which may be an optionally substituted straight chain, branched or cyclo-alkane, (ii) a cyclo alkane having at least two substituents that are $Y—[Z—F]_m$ and (iii) an aryl (such as phenyl). In some examples, X is selected from (i) a branched alkane, with at least at least two of the alkyl branches covalently bonded to $(Y—[Z—F]_m)$ and (ii) a cyclo alkane having at least two substituents that are $Y—[Z—F]_m$ and (iii) an aryl (such as phenyl) having at least two substituents that are $Y—[Z—F]_m$; Y is selected from (i) —O—, —C(═O)—O—, —O—C(═O)— and m is 1 or (ii) Y is $—NH_{2-m}$, wherein m is 1 or 2; Z is $C_{1-4}$ alkylene; F is an epoxide of the formula —CH(O)C$R^1$H, wherein $R^1$ is selected from H and methyl, and in some examples F is an epoxide of the formula —CH(O)C$R^1$H in which $R^1$ is H.

In some examples, Z—F is an epoxycycloalkyl group. In some examples, Z—F is an epoxycyclohexyl group. In some examples, Z—F is an epoxycyclohexyl group, in some examples a 3,4 epoxycyclohexyl group. In some examples, the cross-linker comprises two epoxycycloalkyl groups, in some examples two epoxycyclohexyl groups.

In some examples, the cross-linker comprises two epoxycycloalkyl groups, which are bonded to one another via a linker species; and the linker species may be selected from a single bond, optionally substituted alkyl, optionally substituted aryl, optionally substituted arylalkyl, optionally substituted alkylaryl, isocyanurate, a polysiloxane, —O—, —C(═O)—O—, —O—C(═O)—, and amino and combinations thereof. In some examples, the linker species may be selected from alkylene, —O—, —C(═O)—O— and —O—C(═O)—. In some examples, the linker species may be selected from —C(═O)—O— and —O—C(═O)—.

In some examples the epoxy-based cross-linker is selected from the DECH family of epoxy-based cross-linkers (including 3,4-Epoxycyclohexylmethyl 3,4-epoxycyclohexanecarboxylate and 7-oxabicyclo[4.1.0]hept-3-ylmethyl 7-oxabicyclo[4.1.0]heptane-3-carboxylate) and tris(4-hydroxyphenyl)methane triglycidyl ether. In some examples the epoxy-based cross-linker is selected from 3,4-Epoxycyclohexylmethyl 3,4-epoxycyclohexanecarboxylate and 7-oxabicyclo[4.1.0]hept-3-ylmethyl 7-oxabicyclo[4.1.0]heptane-3-carboxylate, in some examples 7-oxabicyclo[4.1.0]hept-3-ylmethyl 7-oxabicyclo[4.1.0]heptane-3-carboxylate.

In some examples, the cross-linker is an aziridine-based cross-linker, for example a polyaziridine. The term 'polyaziridine' is used herein to refer to a molecule comprising at least two aziridine groups, e.g. of the formula —N($CH_2CR^2H$), wherein $R^2$ is selected from H and alkyl (e.g. methyl), in some examples wherein $R^2$ is methyl.

In some examples, the aziridine-based cross-linker is of the formula (II).

$$(S)\text{-}(T\text{-}[W\text{—}V]_i)_k$$

wherein, in each (T-[W—V]$_i$), T, W and V are each independently selected, such that V is an aziridine group, e.g. of the formula —N($CH_2CR^2H$), wherein $R^2$ is selected from H and alkyl;

W is alkylene,

T is selected from a single bond, —O—, —C(═O)—O—, —O—C(═O)— and i is 1 or (ii) Y is $NH_{2-i}$. wherein i is 1 or 2, k is at least 1, in some example at least 2, in some examples at least 3, in some examples 1-4, in some examples 2-4, and S is an organic group.

In some examples, the cross-linker of formula (II) has at least two V groups, in some examples at least three V groups.

In some examples, V is an aziridine of the formula —N($CH_2CR^2H$) in which $R^2$ is alkyl, in some examples $R^2$ is methyl.

S may comprise or be an organic group selected from optionally substituted alkylene, optionally substituted alkyl, optionally substituted aryl, optionally substituted arylalkyl, optionally substituted alkylaryl, isocyanurate, and a polysiloxane. S may comprise a polymeric component; in some examples the polymeric components may be selected from a polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples S comprises a polymeric backbone, comprising a plurality of repeating units, each of which is covalently bonded to (T-[W—V]$_i$), with T, W, V and i as described herein. S may be selected from a group selected from a branched or straight-chain $C_{1-12}$ alkyl (e.g. $C_{1-6}$).

In some examples, S is a branched-chain alkyl (e.g. trimethyl propane) in which each of the alkyl branch groups (e.g. each of the methyl groups when S is trimethyl propane) are substituted with a (T-[W—V]$_i$) group (i.e. k is 3 when S is trimethyl propane), in which T is selected from —O—, —C(═O)—O—, —O—C(═O)—, in some examples —O—C(═O)—; i is 1; W is $C_{1-4}$ alkylene, in some examples methylene (—$CH_2$—) or ethylene (—CH2-CH2-), in some examples ethylene; and V is an aziridine group of the formula —N($CH_2CR^2H$) in which $R^2$ is alkyl, in some examples, methyl.

In some examples the aziridine-based cross-linker is trimethylolpropane tris(2-methyl-1-azridinepropionate) (XAMA®-2).

In some examples, the cross-linker is an isocyanate-based cross-linker, for example a polyisocyanate. The term 'polyisocyanate' is used herein to refer to a molecule comprising at least two isocyanate groups, e.g. of the formula —NCO.

In some examples, the isocyanate based cross-linker is selected from polymethylene diphenyl isocyanates, biuret, hexamethylene diisocyanate trimer (trimer of HDI), uretdion dimer (Alipa), blocked isocyanates (Cytec, Bayer, Alipa) and aliphatic polyisocyanates.

In some examples, the isocyanate based cross-linker is selected from polymethylene diphenyl isocyanates (e.g. Papi27 (Dow), Desmodur44V20 (Bayer), Suprasec5024 (Huntsman)), biuret, hexamethylene diisocyanate trimer (trimer of HDI), uretdion dimer (Alipa), blocked isocyanates (Cytec, Bayer, Alipa), aliphatic polyisocyanates, tolylene diisocyanate, diphenylmethane diisocyanate, naphthalene diisocyanate, xylylene diisocyanate, hydrogenated xylylene diisocyanate, hexamethylene diisocyanate, trimethylhexamethylene diisocyanate, isophorone diisocyanate, methylene-bis(4-cyclohexyl isocyanate),

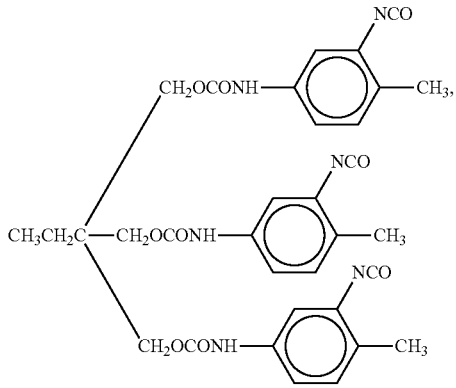

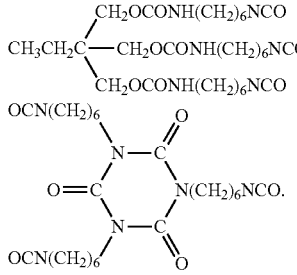

In some examples, the cross-linker is a carbodiimide-based cross-linker, for example a polycarbodiimide. The term 'polycarbodiimide' is used herein to refer to a molecule comprising at least two carbodiimide groups, e.g. of the formula —NCN—.

In some examples, the carbodiimide based cross-linker is SV-02 Carbodilite.

In some examples, the cross-linker is selected from organic metallic complexes or ions, for examples ionomers and $Zn^{2+}$, $Ca^{2+}$ containing compounds.

In some examples, the cross-linker comprises a maleic anhydride, e.g. the cross-linker may be a maleic anhydride-based cross-linker. In some examples, the cross-linker is a polymaleic anhydride.

In some examples, the maleic anhydride-based cross-linker is of formula (III),

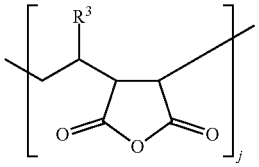

where $R^3$ is H or alkyl and j is greater than 1.

In some examples, j is greater than 10, in some examples greater than 100.

In some examples, $R^3$ is H or $C_{1-20}$ alkyl (e.g. $C_{16}$ alkyl).

In some examples, the maleic anhydride-based cross-linker is polymaleic anhydride 1-octadecene (available from Polyscience), poly(ethylene-alt-maleic anhydride) (available from Sigma).

In some examples, the cross-linker comprise an anhydride. In some examples, the cross-linker is an anhydride based cross-linker, e.g. a cross-linker comprising the group —C(O)OC(O)—.

In some examples, the anhydride based cross-linker is a cyclic anhydride, in some examples a cyclic anhydride of formula (IV)

$$R^4C(O)OC(O)R^5$$

where $R^4$ and $R^5$ are linked to form an optionally substituted ring.

In some examples, the anhydride based cross-linker is glutaric anhydride or phtalic anhydride.

In some examples, the cross-linker comprises a polyanhydride, for example polyacrylic anhydride or polymethacrylic anhydride.

In some examples, the cross-linker comprises an aldehyde. In some examples, the cross-linker is an aldehyde-based cross-linker, for example a polyaldehyde. The term 'polyaldehyde' is used herein to refer to a molecule comprising at least two aldehyde groups, e.g. of the formula —C(O)H.

In some examples, the cross-linker comprises a ketone. In some examples, the cross-linker is a ketone-based cross-linker, for example a polyketone. The term 'polyketone' is used herein to refer to a molecule comprising at least two ketone groups.

In some examples, the cross-linker comprises an acetyl acetonate. In some examples, the cross-linker is an acetyl acetonate based cross-linker, for example Acetoacetoxyethyl Methacrylate (Eastman™ AAEM).

In some examples, the cross-linker comprises an organosilane, for example a cross-linker comprising a silane group. In some examples, the organosilane may be of the formula $R'Si(R^6)(R^7)(R^8)$ wherein $R^6$, $R^7$ and $R^8$ are independently selected from optionally substituted alkoxy, optionally substituted alkyl and optionally substituted aryl; and R' is selected from optionally substituted alkoxy, optionally substituted alkyl (e.g. aminoalkyl) and optionally substituted aryl. In some examples, $R^6$, $R^7$ and $R^8$ are all alkyl, e.g. methyl. In some examples, R' is optionally substituted alkyl, e.g. amino substituted alkyl (e.g. $C_{1-12}$ aminoalkyl), or isocyanate substituted alkyl. In some examples, R' is $C_{1-6}$ aminoalkyl (e.g. aminopropyl).

In some examples, the cross-linker comprises trimethylaminopropylsilane.

In some examples, the cross-linker comprises an epoxy-organosilane, for example a cross-linker comprising a silane group (e.g. a group of formula $—Si(R^6)(R^7)(R^8)$ as described above) and an epoxy group as described above.

In some examples, the cross-linker comprises an epoxy-organosilane selected from epoxypropyltrimetoxysilane and oligomeric polyepoxysilane.

Over Print Varnish (OPV)

In some examples, the printed material may comprise an over print varnish (OPV) disposed on the cross-linking composition or the printed ink layer of the printed material.

In some examples, the printed material comprises an OPV disposed on the cross-linking composition.

In some examples, the printed material comprises an OPV disposed on the printed ink layer.

In some examples the OPV is a water-based OPV (e.g. an OPV comprising an OPV dispersed in water), a solvent-based OPV (e.g. an OPV comprising an OPV resin dissolved in an organic solvent such as ethyl acetate, n-propanol or ethanol), a UV curable OPV (e.g. an OPV comprising an OPV UV curable resin and a photo-initiator) or an electron beam OPV. Suitable OPV are standardly used OPVs.

In some examples the OPV comprises an OPV resin comprising an acrylate resin, a polyurethane resin or a nitrocellulose resin. When the OPV resin comprises a polyurethane resin, the OPV resin may comprise a one component or a two component polyurethane resin.

In some examples, the OPV is selected from a water-based OPV comprising acrylate resin or polyurethane resin; a solvent-based OPV comprising nitrocellulose resin or polyurethane resin; and a UV curable OPV comprising acrylate resin or polyurethane resin.

In some examples, the OPV is deposited on the print substrate such that the coat weight of the OPV resin on the print substrate is in the range of about 0.5 $g \cdot m^{-2}$ to about 10 $g \cdot m^{-2}$, in some examples about 1 $g \cdot m^{-2}$ to about 5 $g \cdot m^{-2}$.

Process for Preparing the Printed Material

Described herein is a process for preparing a printed material comprising: providing a print substrate comprising a primer on a surface of the print substrate, the primer comprising a primer resin; printing an ink composition comprising a thermoplastic resin onto the primer on the surface of the print substrate; and depositing a cross-linking composition comprising a cross-linker onto the printed ink composition disposed on the primer such that the thermoplastic resin of the ink composition is crosslinked and the primer resin of the primer is crosslinked.

The processes described herein is depicted generally in the FIGURE, in which the following reference numerals are used to identify the features indicated: reference numeral "1" denotes a printed material; reference numeral "6" denotes a primer; reference numeral "2" denotes a print substrate; reference numeral "3" denotes an ink composition; and reference numeral "4" denotes a cross-linking composition.

The FIGURE depicts a process in which a print substrate 2 is provided with a primer 6 on a surface thereof and an ink composition 3 comprising a thermoplastic resin is printed on to the print substrate 2. A cross-linking composition 4 comprising a cross-linker is then deposited onto the printed ink composition 3 disposed on the print substrate 2 to form a printed material 1.

In some examples, printing an ink composition onto the print substrate 2 may comprise printing any ink composition described herein on the print substrate 2 by any suitable printing process.

In some examples, the primer 6 comprising a primer resin is provided on the print substrate in an amount such that the coat weight of the primer resin measured over the area of the first surface of the print substrate is at least 0.01 g/m$^2$, in some examples at least 0.05 g/m$^2$, in some examples at least 0.1 g/m$^2$, in some examples at least 0.15 g/m$^2$, in some examples about 0.18 g/m$^2$. In some examples the primer is provided in an amount such that the coat weight of the primer resin measured over the area of the first surface of the print substrate is up to about 0.2 g/m$^2$, in some examples up to about 0.5 g/m$^2$, in some examples up to about 1 g/m$^2$, in some examples up to about 1.5 g/m$^2$.

In some examples, providing the flexible print substrate with a primer on a surface thereof comprising depositing a primer comprising a primer resin on the print substrate. The primer may be deposited on the flexible print substrate using any technique standardly used, for example, gravure coating, flexo coating, screen coating or electrophotographic printing. In some examples, the primer may be deposited on the flexible print substrate using a process in-line with the printing of the ink composition to the surface of the flexible print substrate on which the primer is deposited. In some examples, the process comprises applying a corona treatment to the surface of the flexible print substrate before deposition of the primer onto the surface of the print substrate.

In some examples, the process comprises applying a corona treatment to the primer disposed on the surface of the flexible print substrate before printing an ink composition on to the primer disposed on the surface of the flexible print substrate.

In some examples, printing an ink composition onto the flexible print substrate comprises printing an electrostatic ink composition, e.g. a liquid electrophotographic ink composition, onto the print substrate in an electrophotographic or electrostatic printing process using an electrophotographic or electrostatic printing apparatus. Examples of suitable electrophotographic or electrostatic printing equipment are the HP Indigo digital presses. In some examples, the process may comprise electrophotographically printing a liquid electrophotographic ink composition onto the print substrate.

In some examples, an ink composition comprising a thermoplastic resin is printed on the flexible print substrate in an amount such that the coat weight of the thermoplastic resin measured over the area of the first surface of the print substrate is at least 0.01 g/m$^2$, in some examples at least 0.05 g/m$^2$, in some examples at least 0.1 g/m$^2$, in some examples at least 0.5 g/m$^2$, in some examples about 1 g/m$^2$. In some examples the ink composition is printed in an amount such that a coat weight of the thermoplastic resin measured over the area of the first surface of the print substrate of up to about 16 g/m$^2$, in some examples up to about 10 g/m$^2$, in some examples up to about 5 g/m$^2$, in some examples up to about 4 g/m$^2$.

In some examples, the process comprises applying a corona treatment to the printed ink composition disposed on the primed flexible print substrate before deposition of a cross-linking composition onto the printed ink composition disposed on the print substrate.

In some examples, the cross-linking composition may be applied to the printed ink composition disposed on the flexible print substrate using any suitable coating process. In some examples, the cross-linking composition is deposited onto the printed ink composition using a flexo coating, gravure, offset, or screen printing process. In some examples, the cross-linking composition is applied onto the printed ink composition using a printing machine, in some examples, the cross-linking composition is applied onto the printed ink composition using a laminator.

In some examples, the cross-linking composition may be applied to the printed ink composition and primer on the print substrate which may have been left exposed after printing of the ink composition onto the primer on a surface of the print substrate.

In some examples, depositing the cross-linking composition on to the printed ink composition comprises depositing a cross-linking composition comprising a cross-linker for cross-linking the thermoplastic resin of the ink composition and a cross-linker for cross-linking the primer resin of the primer. In some examples, depositing the cross-linking composition on to the printed ink composition comprises depositing a cross-linking composition comprising a cross-linker for cross-linking the thermoplastic resin of the ink composition and for cross-linking the primer resin of the primer. In some examples, deposition the cross-linking composition on to the printed ink composition may comprise depositing a cross-linking composition for cross-linking the thermoplastic resin of the ink composition and depositing an additional cross-linking composition comprising a cross-linker for cross-linking the primer resin of the primer.

In some examples, the cross-linking composition is deposited on the printed ink composition disposed on the print substrate in an amount such that the coat weight of the cross-linker measured over the area of the first surface of the print substrate is at least 0.01 g/m$^2$, in some examples at least 0.02 g/m$^2$, in some examples at least 0.03 g/m$^2$, in some examples at least 0.04 g/m$^2$, in some examples at least 0.05 g/m$^2$, in some examples at least 0.06 g/m$^2$, in some examples at least 0.08 g/m$^2$, in some examples at least 0.1 g/m$^2$, in some examples at least 0.12 g/m$^2$, in some examples at least 0.15 g/m$^2$, in some examples at least 0.18 g/m$^2$, in some examples at least about 0.2 g/m$^2$, in some examples at least about 0.3 g/m$^2$, in some examples at least about 0.4 g/m$^2$, in some examples at least 0.5 g/m$^2$.

In some examples, the cross-linking composition is deposited on the printed ink composition disposed on the print substrate in an amount such that the coat weight of the cross-linker measured over the area of the first surface of the print substrate up to about 0.4 g/m$^2$, in some examples up to about 0.8 g/m$^2$, in some examples up to about 1 g/m$^2$.

In some examples, the cross-linking composition is deposited on the printed ink composition disposed on the print substrate in an amount such that the coat weight of the cross-linker measured over the area of the first surface of the print substrate is from about 0.04 to about 0.8 g/m$^2$, in some examples from about 0.04 to about 0.4 g/m$^2$, in some examples from about 0.04 to about 0.2 g/m$^2$.

In some examples, the process comprises applying a corona treatment to the printed flexible substrate before depositing the cross-linking composition on the flexible print substrate.

In some examples, the process of preparing a printed material further comprise activating the cross-linking composition after deposition of the cross-linking composition on the printed ink composition disposed on the print substrate. In some examples, activation of the cross-linking composition results in the formation of a cross-linked product of the cross-linker and the thermoplastic resin (i.e. a cross-linked thermoplastic resin). In some examples, activation of the cross-linking composition results in the formation of a cross-linked product of a cross-linker and the thermoplastic resin (i.e. a cross-linked thermoplastic resin) and a cross-linked product of a cross-linker and the primer resin (i.e. a cross-linked primer resin). In some examples, activation of the cross-linking composition results in the formation of a cross-linked product of a cross-linker and the thermoplastic resin (i.e. a cross-linked thermoplastic resin), a cross-linked product of a cross-linker and the primer resin (i.e. a cross-linked primer resin) and a cross-linked product of a cross-linker, the primer resin and the thermoplastic resin. In some examples, activation of the cross-linking composition may comprise heating the cross-linking composition. In some examples, activation of the cross-linking composition comprises heating the cross-linking composition to evaporate a cross-linking composition carrier solvent. In some examples, activation of the cross-linking composition comprises heating the cross-linking composition to a temperature of at least 50° C., in some examples at least 60° C., in some examples at least 70° C., in some examples at least 80° C., in some examples at least 90° C., in some examples at least 100° C., in some examples at least 110° C., in some examples at least 120° C., in some examples up to about 200° C.

In some examples, the crosslinking of the thermoplastic resin by the cross-linker and the crosslinking of the primer resin by the cross-linker is initiated and/or promoted by light (photoinitiation), such as ultraviolet light (UV photoinitiation); heat (thermal initiation); electron beam (e-beam initiation); ionising radiation, such as gamma radiation (gamma initiation); non-ionising radiation, such as microwave radiation (microwave initiation); or any combination thereof.

In some examples, the process comprises applying a corona treatment to the surface of the flexible print substrate on which the cross-linking composition has been deposited before deposition of an OPV on the print substrate.

In some examples, the cross-linking composition is activated after deposition on the printed ink composition disposed on the print substrate. In some examples, the cross-linking composition is activated prior to deposition of an OPV on the print substrate. In some examples, the cross-linking composition is activated after deposition of an OPV on the print substrate.

In some examples, an OPV may be deposited on the print substrate to further protect the ink composition printed on the print substrate. In some examples, the OPV may be deposited on the print substrate such that the OPV is disposed on the cross-linking composition which is disposed on the printed ink composition on the print substrate. In some examples, the OPV may be deposited on the print substrate such that the OPV is disposed on the cross-linked printed ink composition disposed on the print substrate. Deposition of the OPV onto the print substrate may take place by any suitable coating process, for example flexo coating, gravure coating or screen printing.

In some examples, the print substrate has a second surface on which a sealant layer is disposed. In some examples, the second surface is a surface of the print substrate other than a surface of the print substrate to which the ink composition is printed. In some examples, the sealant layer may be deposited on the second surface of the print substrate before printing of the ink composition, deposition of the cross-linking composition and/or depositing of an OPV. In some examples, the sealant layer may be deposited on the second surface of the print substrate after the print substrate is printed with an ink composition. In some examples, the sealant layer may be deposited on the second surface of the print substrate after a cross-linking composition has been deposited on the printed ink composition disposed on the print substrate. In some examples, the sealant layer may be deposited on the second surface of the print substrate after an OPV has been deposited on the print substrate to protect the ink composition printed on the print substrate.

In some examples, providing a sealant layer on the print substrate comprises depositing a sealant material to form a sealant layer on the second surface of the print substrate. The material used to form the sealant layer may be as described previously. Deposition of the sealant material onto the second surface of the print substrate may take place by any suitable process, for example, extrusion coating, flexo coating, gravure or screen printing. In some examples, the print substrate and sealant layer are pre-formed as a functional substrate.

In some examples, the process comprises:

providing a flexible print substrate comprising a primer on a surface of the print substrate, the primer comprising a primer resin comprising an amine functional group;

printing an ink composition comprising a thermoplastic resin onto the primer on the surface of the print substrate, the thermoplastic resin comprising a polymer having acidic side groups; and depositing a cross-linking composition comprising a cross-linker selected from an epoxy-based cross-linker, a aziridine-based cross-linker, an isocyanante-based cross-linker and a carbodiimide-based cross-linker onto the printed ink composition disposed on the primer such that the thermoplastic resin of the ink composition is crosslinked, the primer resin of the primer is cross-linked and the thermoplastic resin of the ink composition is crosslinked with the primer resin of the primer.

In some examples, the flexible printed material comprises:

a flexible print substrate;

a primer layer comprising a primer resin disposed on surface of the print substrate, the primer resin comprising an amine functional group;

a printed ink layer comprising a thermoplastic resin disposed on the primer layer, the thermoplastic resin comprising a polymer having acidic side groups; and a cross-linker selected from an epoxy-based cross-linker, a aziridine-based cross-linker, an isocyanante-based cross-linker and a carbodiimide-based cross-linker applied to the printed ink layer such that the thermoplastic resin is crosslinked, the primer resin is cross-linked and the thermoplastic resin and the primer resin are crosslinked.

In some examples, the process comprises:

providing a flexible print substrate comprising a primer on a surface of the print substrate, the primer comprising a primer resin comprising an amine functional group;

printing an ink composition comprising a thermoplastic resin onto the primer on the surface of the print substrate, the thermoplastic resin comprising a polymer having acidic side groups; and depositing a cross-linking composition comprising an epoxy-based cross-linker onto the printed ink composition disposed on the primer such that the thermoplastic resin of the ink composition is crosslinked, the primer resin of the primer is crosslinked and the thermoplastic resin of the ink composition is crosslinked with the primer resin of the primer.

In some examples, the flexible printed material comprises:

a flexible print substrate;

a primer layer comprising a primer resin disposed on surface of the print substrate, the primer resin comprising an amine functional group;

a printed ink layer comprising a thermoplastic resin disposed on the primer layer, the thermoplastic resin comprising a polymer having acidic side groups; and an epoxy-based cross-linker applied to the printed ink layer such that the thermoplastic resin is crosslinked, the primer resin is crosslinked and the thermoplastic resin and the primer resin are crosslinked.

EXAMPLES

The following illustrates examples of the materials, methods and related aspects described herein. Thus, these examples should not be considered to restrict the present disclosure, but are merely in place to teach how to make examples of compositions of the present disclosure. As such, a representative number of compositions and their method of manufacture are disclosed herein.

Example 1

A flexible print substrate comprising a primer on a surface of the print substrate to which an ink composition was printed was prepared by providing a pre-laminated PET/MDPE film (polyethylene terephthalate 12 μm, pre-laminated to medium density polyethylene having a thickness of 90 μm) primed with DP050 (primer containing polyethylene imine as the primer resin, available from Michelman). The primer was applied such that the coat weight of polyethylene imine as the primer resin was 0.13 gsm. An image was electrostatically printed using a HP Indigo WS6600 printing press and Electrolnk® 4.5 (available from HP Indigo), a liquid electrophotographic ink composition comprising a thermoplastic resin comprising ethylene acrylic acid, ethylene methacrylic acid copolymers) with a 300% ink coverage (100% W, 100% K, 33% Y, 33% M, 33% C—3.0 gsm coat weight of the thermoplastic resin on the print substrate).

The printed substrate was then coated using a laboratory laminator (LaboCombi, Nordmeccanica) at a process speed of 30 m/min with a cross linking composition (DECH—7-oxabicyclo[4.1.0]hept-3-ylmethyl 7-oxabicyclo[4.1.0]heptane-3-carboxylatecross-linker dissolved in ethyl acetate at a solid percentage by weight to ethyl acetate of 0.5%) to provide a coat weight of the cross-linker of 0.02 gsm.

The cross linker was activated during solvent evaporation by using the 3 ovens of the coater (the laminator—LaboCombi, Nordmeccanica) at 70° C., 100° C. and 120° C., speed of coating was 30 m/min.

The flexible print substrate printed with the ink composition and coated with the cross-linking composition was subjected to Corona treatment (1000 Watt) and then an overprint varnish (Siegwerk DA 2K 15 solvent base two component over print varnish (10-604784-8 DA 2K 15 with 10-600015-1 hardener, 100:15 mixing ratio)) was then applied to the Corona treated surface using a laminator (LaboCombi, Nordmeccanica 0.4 m width, oven 50° C., speed 40 m/min, coat weight of overprint varnish (OPV) 2.0 gsm, Anilox 70 lcm to provide a flexible printed material.

Example 2

A flexible printed material was prepared as for Example 1 except that the cross-linking composition contained DECH—7-oxabicyclo[4.1.0]hept-3-ylmethyl 7-oxabicyclo[4.1.0]heptane-3-carboxylate cross-linker dissolved in ethyl acetate at a solid percentage by weight to ethyl acetate of 1% and the cross-linking composition was applied to provide a coat weight of the cross-linker of 0.04 gsm on the printed substrate.

Example 3

A flexible printed material was prepared as for Example 1 except that the cross-linking composition contained DECH—7-oxabicyclo[4.1.0]hept-3-ylmethyl 7-oxabicyclo[4.1.0]heptane-3-carboxylate cross-linker dissolved in ethyl acetate at a solid percentage by weight to ethyl acetate of 2.5% and the cross-linking composition was applied to provide a coat weight of the cross-linker of 0.1 gsm on the printed substrate.

Example 4

A flexible printed material was prepared as for Example 1 except that the cross-linking composition contained DECH—7-oxabicyclo[4.1.0]hept-3-ylmethyl 7-oxabicyclo[4.1.0]heptane-3-carboxylate cross-linker dissolved in ethyl acetate at a solid percentage by weight to ethyl acetate of 5% and the cross-linking composition was applied to provide a coat weight of the cross-linker of 0.2 gsm on the printed substrate.

Reference Example 5

A flexible printed material was prepared as for Example 1 except that no cross-linking composition was applied to the printed substrate.

Flexible printed materials according to Examples 1-4 and Reference Example 5 were also prepared with an ink coverage of the printed ink composition on the primed print substrate of 500% (100% W, 100% K, 100% Y, 100% M, 100% C—5.0 gsm coat weight of the thermoplastic resin on the print substrate).

Example 6

A flexible printed material was prepared as for Example 4 except that the overprint varnish (OPV) applied to the Corona treated print substrate printed with the ink composition and coated with the cross-linking composition was a UV OPV (Pulse IV 018 Matt UV OPV) which was applied using ABG Digicoat using 200×40 anlilox to apply 3.0-5.0 gsm dry coat weight (Max power 100%, 20 m/min machine speed).

Example 7

A flexible printed material was prepared as for Example 4 except that no overprint varnish (OPV) was applied.

Reference Example 8

A flexible printed material was prepared as for Reference Example 5 except that the overprint varnish (OPV) applied to the Corona treated print substrate printed with the ink composition and coated with the cross-linking composition was a UV OPV (Pulse IV 018 Matt UV OPV) which was applied using ABG Digicoat using 200×40 anlilox to apply 3.0-5.0 gsm dry coat weight (Max power 100%, 20 m/min machine speed).

Reference Example 9

A flexible printed material was prepared as for Reference Example 5 except that no overprint varnish (OPV) was applied.

Test 1—Heat Sealing Resistance

Some ink compositions, for example LEP ink compositions, may be sensitive to sealing (the melting temperature of the thermoplastic resin in LEP ink is around 80° C.) due to the high sealing temperature (ranging from 110-220° C. at various time, depending on the application). Melting of ink compositions, for example LEP ink compositions, may cause movement of the printed ink composition which can lead to colour changes. Colour change in the printed image or information during or after heat sealing is unacceptable to most customers.

The flexible printed materials of Examples 1-4 and Reference Example 5 were tested for heat sealing resistance by placing a printed material between grooved jaws both heated to 180° C. and contacting the grooved jaws around the flexible printed material (4 bars, 1 second dwell time).

After undergoing the heat sealing test, any color changes (CC) and/or mechanical ink and OPV movement (MIM) in the printed materials was observed visually. The results of the heat sealing test are shown in Table 1 below.

TABLE 1

| Printed material | Ink Coverage 300% | Ink Coverage 500% |
|---|---|---|
| Example 1 | Some CC and MIM | Some CC and MIM |
| Example 2 | Some CC and MIM | Minimal CC and MIM |
| Example 3 | No/very little CC or MIM | Minimal CC and MIM |
| Example 4 | No/very little CC or MIM | No/very little CC or MIM |
| Reference Example 5 | CC and MIM | CC and MIM |

The heat sealing resistance of the flexible printed materials was found to be improved with increasing amounts of cross-linker compared to the printed material of Reference Example 5 which contained no cross-linker.

The flexible printed materials of Examples 6 and 7 and Reference Example 8 were also tested for heat sealing resistance by placing a printed material between grooved jaws heated to 180° C. and contacting the grooved jaws around the printed material at a pressure of 4 bars for 1 second. The printed material of Reference Example 8 showed severe color change and mechanical ink/OPV movement. An improvement in color change and mechanical ink movement was observed for the heat sealing tested printed material of Example 7 (cross-linking composition, no OPV) compared with the material of Reference Example 8. The printed material of Example 6 showed further improvement compared to the material of Example 7. The same results were observed when heat sealing resistance was tested using flat jaws with Teflon cover (both heated to 200° C., 3 bars, 1 second dwell time).

Test 2—Abrasion Resistance

The flexible printed materials of Examples 1-4 and Reference Example 5 were tested for mechanical wear of the printed ink and overprint varnish using a standard Sutherland abrasion test (ASTM D5264-94). The test was done using a standard 3M lapping film—9μ (261X), 4 pound weight and speed 1 for 10 times.

The best result observed for the flexible material of Example 7 which was treated with 5% cross linker, for this material no damage on the varnish and ink was observed after 20 stroke recurrences. The results of the abrasion test are shown in Table 2 below.

TABLE 2

| Printed material | Abrasion test - Number of stroke recurrences 5 | 10 | 20 | 30 |
|---|---|---|---|---|
| Example 1 | Damage to ink or primer observed | | | |
| Example 2 | Damage to ink or primer observed | | | |
| Example 3 | Damage to ink or primer observed | | | |
| Example 4 | No damage to ink or primer | No damage to ink or primer | No damage to ink or primer | Damage to ink or primer observed |
| Reference Example 5 | Damage to ink or primer observed | | | |

Damage to the printed ink and/or primer was observed for each of the materials of Examples 1-3 and Reference Example 5 after 5 stroke recurrences in the abrasion test. However, each of the materials of Examples 1-3 showed less damage than the material of Reference Example 5 after 5 stroke recurrences in the abrasion test. The durability of the materials was found to increase with increasing amounts of cross-linker in the cross-linking composition.

Test 3—Shear and Scratch Resistance

The flexible printed materials of Examples 6 and 7 and Reference Examples 8 and 9 were tested for shear and scratch resistance using a Taber® Shear instrument. In this test the printed side of the printed materials were scratched with a Tungsten carbide nail (50 gr. load) and the debris (ink removed by the nail) are weighed (ASTM C217). The lower the weight of the debris, the more durable the printed material. Following the Taber scratch test, the amount removed from the scratched surface was weighed using an analytical scale. Three measurements were taken for each sample. The results are shown in Table 3 below.

TABLE 3

| | Reference Example 8 | Example 6 | Example 7 | Reference Example 9 |
|---|---|---|---|---|
| Average weight of debris removed +/− Standard deviation | 0.46 +/− 0.05 | 0.32 +/− 0.03 | 0.38 +/− 0.01 | 0.52 +/− 0.02 |

The flexible printed materials comprising a cross-linker showed improved shear and scratch resistance compared to the materials to which no cross-linking composition was applied.

The flexible printed materials of Examples 1-4, 6 and 7 were also found to show improved chemical resistance, e.g. water resistance, compared to the flexible printed materials of Reference Examples 5, 8 and 9.

It has been found that depositing a cross-linking composition comprising a cross-linker onto the printed ink composition disposed on the print substrate improves heat sealing, abrasion and shear and scratch resistance of the surface printed samples. Without wishing to be bound by theory, it is thought that cross-liner reinforces the ink matrix by cross-linking the thermoplastic resin within the ink composition and therefore preventing mechanical ink movement upon heat sealing. The improved shear, scratch and abrasion resistance of the surface printed samples prepared by depositing a cross-linking composition comprising a cross-linker onto the printed ink composition disposed on the printed substrate also suggests penetration of the cross-linker to the primer and the primer-ink interfaces to reinforce the primer and the primer-ink interface.

Experiments were also carried out to produce printed materials using different cross-linking compositions, for example cross-linking compositions comprising a 3,4-Epoxycyclohexylmethyl 3,4-epoxycyclohexanecarboxylate, tris(4-hydroxyphenyl)methane triglycidyl ether, trimethylpropane tris(2-methyl-1-azridinepropionate) (XAMA®-2) or polycarbodiimide SV-02 cross-linker. These printed materials were also found to show improved heat sealing, mechanical durability and chemical resistance compared to reference materials in which no cross-linker was present.

Experiments were also carried out to produce printed materials using cross-linking compositions comprising a polyisocyanate as the cross-linker, e.g. polymethylene diphenyl isocyanates, e.g. Papi27 (Dow), Desmodur44V20 (Bayer), Suprasec5024 (Huntsman), biuret, trimer of HDI, uretdion dimer (Alipa), blocked isocyanates (Cytec, Bayer, Alipa), aliphatic polyisoconates (EP0136074) or TDI—toluene-2,4-diisocyanate (Sigma). These printed materials were also found to show improved heat sealing, mechanical durability and chemical resistance compared to reference materials in which no cross-linker was present.

While the materials, methods and related aspects have been described with reference to certain examples, it will be appreciated that various modifications, changes, omissions, and substitutions can be made without departing from the spirit of the disclosure. The features of any dependent claim may be combined with the features of any of the other dependent claims or any and/or any of the independent claims.

The invention claimed is:

1. A process for preparing a printed material comprising:

providing a print substrate comprising a primer on a first surface of the print substrate, the primer comprising a polyethylene imine;

printing an ink composition comprising a thermoplastic resin onto the primer on the first surface of the print substrate;

depositing a cross-linking composition comprising a cross-linker-onto the printed ink composition disposed on the primer such that the thermoplastic resin of the ink composition is crosslinked and the polyethylene imine of the primer is crosslinked; and depositing a sealant layer directly on a second surface of the print substrate, wherein the second surface is opposing the first surface of the print substrate.

2. The process according to claim 1, wherein the thermoplastic resin of the ink composition is selected from the group consisting of alkylene acrylic acid resins, alkylene methacrylic acid resins, polyurethane resins, polyethylene imine resins, polyamide resins, polyvinyl alcohol, and combinations thereof.

3. The process according to claim 1, wherein the thermoplastic resin of the ink composition comprises a polymer having acidic side groups.

4. The process according to claim 1, wherein the ink composition is a liquid electrophotographic ink composition and the thermoplastic resin comprises a copolymer of an alkylene monomer and a monomer selected from acrylic acid and methacrylic acid.

5. The process according to claim 1, wherein the cross-linking composition comprises an epoxy cross-linker, an aziridine cross-linker, an isocyanate cross-linker or a carbodiimide cross-linker.

6. The process according to claim 5, wherein the cross-linker composition comprises 0.5 wt. % to 10 wt. % of the cross-linker by total weight of the cross-linker composition, the remaining wt. % being a carrier solvent.

7. The process according to claim 1, wherein the thermoplastic resin comprises a polymer having acidic side groups and the cross-linker is an epoxy cross-linker.

8. The process according to claim 1, wherein the cross-linking composition is provided in an amount such that the coat weight of the cross-linker deposited on the printed ink composition is at least 0.05 $gm^{-2}$.

9. The process according to claim 1, wherein the cross-linker is an epoxy cross-linker of the formula (I)

$$(X)—(Y—[Z—F]_m)_n$$

wherein, in each $(Y—[Z—F]_m)$, Y, Z and F are each independently selected, such that:

F is an epoxy group of the formula —CH(O)$R^1$H, wherein $R^1$ is selected from H and alkyl;

Z is alkylene;

Y is selected from a single bond, —O—, —C(=O)—O—, —O—C(=O)—;

m is 1;

n is at least 1; and

X is an organic group.

10. The process according to claim 1 comprising depositing an overprint varnish on the print substrate such that the overprint varnish is disposed on the cross-linking composition.

11. The process according to claim 1 wherein the print substrate is selected from the group consisting of a paper/aluminum/polyethylene laminate, a polyethylene terephthalate/aluminum/polyethylene laminate, an axially oriented polypropylene/metalized-axially oriented polypropylene laminate, and a polyethylene terephthalate/polyethylene laminate.

12. The process according to claim 1 wherein the print substrate is less than 600 μm in thickness.

13. The process according to claim 1 wherein the sealant layer comprises a copolymer of an alkylene monomer and a monomer selected from acrylic acid and methacrylic acid.

14. The process according to claim 1, wherein the cross-linking composition comprises an isocyanate cross-linker or a carbodiimide cross-linker.

15. The process according to claim 1, wherein the cross-linking composition comprises a carbodiimide cross-linker.

16. The process according to claim 1, further comprising at least one of:

applying a corona treatment to the primer disposed on the surface of the print substrate before printing the ink composition on to the primer; or applying a corona treatment to the printed ink composition disposed on the primer before depositing the cross-linking composition onto the printed ink composition.

17. The process according to claim 1, further comprising activating the cross-linking composition after depositing the cross-linking composition on the printed ink composition such that the thermoplastic resin of the ink composition is crosslinked and the polyethylene imine of the primer is crosslinked, wherein activating the cross-linking composition comprises heating the cross-linking composition to a temperature of at least 50° C.

18. The process according to claim 1, wherein the sealant layer comprises a thin film of a polymer, and wherein the film is less than 100 μm in thickness.

* * * * *